US006604554B2

(12) United States Patent
Giulio

(10) Patent No.: US 6,604,554 B2
(45) Date of Patent: Aug. 12, 2003

(54) DEVICE FOR FORMATION OF SKEINED SECTIONS ON THIN METALLIC WIRES

(76) Inventor: Botton Giulio, Via Giambellino 44, Milano I-20100 (IT)

( * ) Notice: Subject to any disclaimer, the term of this patent is extended or adjusted under 35 U.S.C. 154(b) by 59 days.

(21) Appl. No.: 09/979,409

(22) PCT Filed: Mar. 22, 2001

(86) PCT No.: PCT/EP01/03438

§ 371 (c)(1),
(2), (4) Date: Nov. 21, 2001

(87) PCT Pub. No.: WO01/71737

PCT Pub. Date: Sep. 27, 2001

(65) Prior Publication Data

US 2002/0157724 A1 Oct. 31, 2002

(30) Foreign Application Priority Data

Mar. 23, 2000 (EP) ..... 00830220

(51) Int. Cl.[7] ..... H01F 41/06; B21F 3/00
(52) U.S. Cl. ..... 140/102; 242/127
(58) Field of Search ..... 140/102; 242/127, 242/419.9; 28/291

(56) References Cited

U.S. PATENT DOCUMENTS 2,317,250 A * 4/1943 Bridges ..... 242/419.9
3,276,705 A * 10/1966 Erickson et al. ..... 242/419.9
4,620,571 A * 11/1986 Whellams ..... 140/102
4,632,156 A * 12/1986 Whellams ..... 140/102

FOREIGN PATENT DOCUMENTS

EP 0 422 943 * 4/1991
EP 0 424 770 * 5/1991

* cited by examiner

*Primary Examiner*—Lowell A. Larson
(74) *Attorney, Agent, or Firm*—Jones, Waldo, Holbrook & McDonough

(57) ABSTRACT

The device for the formation of skeined sections on thin metallic wires is of the type in which the wire to be skeined extends from an inlet point (9) to an anchor point (15) and is placed under traction by a wire-tightening device (2). A branch of said wire emerging from said anchor point is sent to a wire-tightening device (8) controlled by an electronic control system which controls the skeining operation. The wire-tightener being present the following parts: a pulley (28) connected to an electromagnetic brake (29) with electromagnetic hysteresis; a second pulley (27) located above the first pulley (28) sensitive to the load bearing and sending a signal signifying the load to the control system which regulates the braking action of the brake. The wire descends on a first side of the above mentioned second pulley (27) and then winds on the first pulley (28) and returns to the second side of the second pulley (27) on which it winds for 180° and then again descends on the first side towards a wire winding machine (5) located downstream.

4 Claims, 3 Drawing Sheets

DEVICE FOR FORMATION OF SKEINED SECTIONS ON THIN METALLIC WIRES

Figures 1, 2, 3:
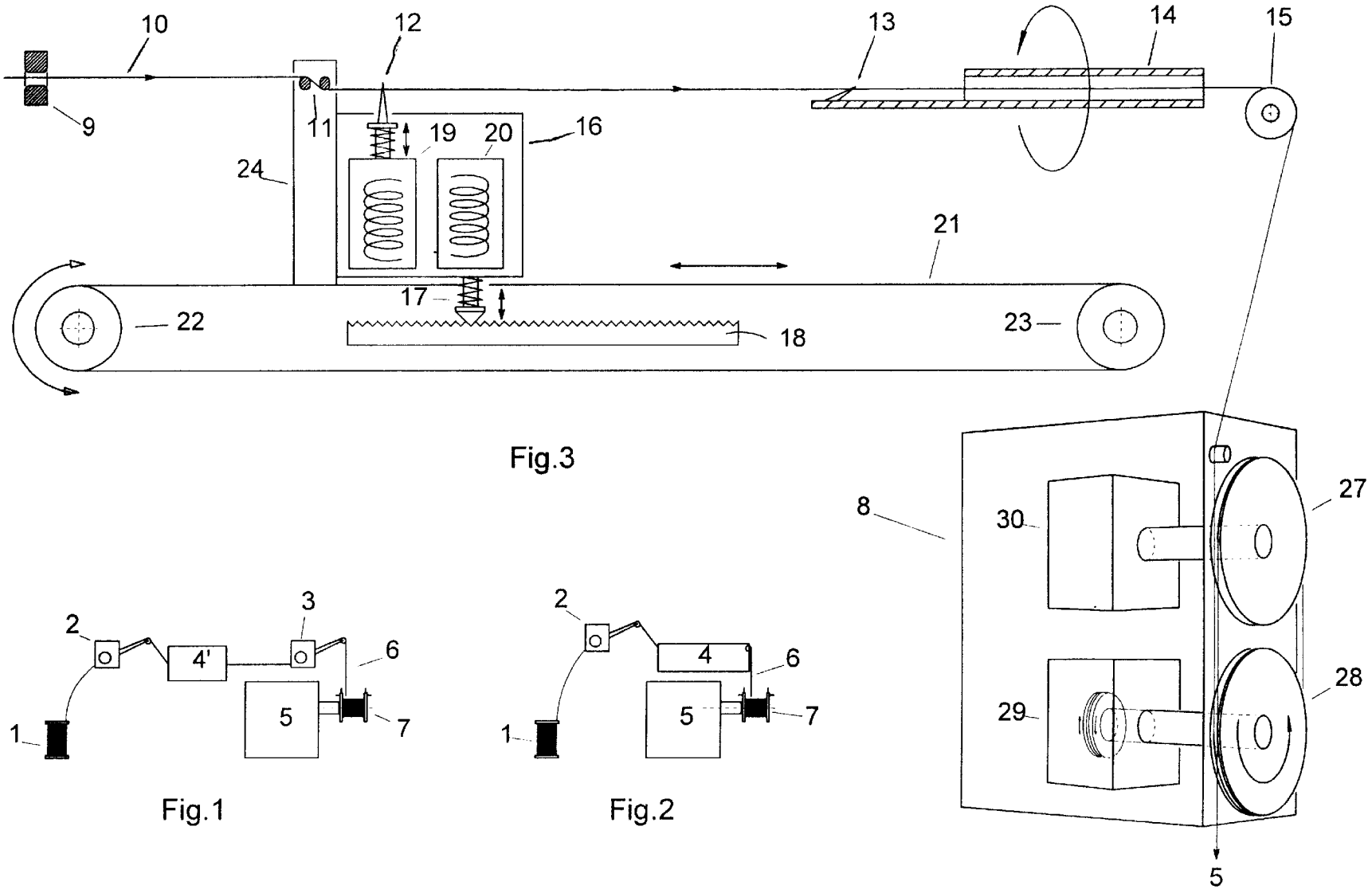

The present invention relates to a device for the formation of skeined sections on thin metallic wires particularly suited for the production of end sections of electrical coil windings.

BACKGROUND

In some industrial applications there is a need for production of very thin metallic wire sections wound in stranded skeins. One of these applications is the production of electrical coils made with very thin wire (thickness less than 0.2 mm) whose winding should display thicker end parts achieved by skeining the winding wire.

Production of these coils requires the solution of various technical problems intended mainly to achieve:

- accurately gauged tensioning of the wire during its winding on the coil and during formation of the skeined ends to prevent irregularity in the winding and in the ends and possible abrasion of the thin insulating film covering the wire,
- skeined sections bearing slots with very small dimensions at their ends,
- fast, gauged recovery of any oversupplying of the wire ('excesses') towards the coil winder which might occur during winding because of momentary slowing, stopping or reversal of winder, and
- correct positioning of the skeined ends on the finished coil.

Known devices for the formation of skeins on thin metallic wires for electrical coil windings are rather slow and complicated and with systems for wire tensioning, recovery of any excesses and positioning of the skeins on the finished coils, which entail drawbacks as specified below.

OBJECTS OF THE INVENTION

The purpose of the present invention is realization of a very simple, fast and reliable device for the formation of thin metallic wire skeins free of the above mentioned shortcomings of the prior art.

In accordance with a preferred embodiment the skein formation device also allows recovery of any wire excesses which might occur during coil winding.

SUMMARY OF THE INVENTION

The device for the formation of skeined sections on thin metallic wires according to the present invention is of the type in which the wire to be skeined extends from an inlet point (9) to an anchor point (15) and is placed under traction by a wire-tightening device (2), said device being characterized in that a branch of said wire emerging from said anchor point is sent to a wire-tightening device (8) controlled by a electronic control system which controls the skeining operation, in said wire-tightener being present the following parts:

- a first pulley (28) on which winds said emerging wire and which is mounted on a second shaft connected to an electromagnetic brake (29) with electromagnetic hysteresis rotated in a direction contrary to the motion given the pulley by the wire,
- a second pulley (27) located above the first pulley (28) and mounted in an idling manner on a pin in turn mounted on a cell (30) sensitive to the load bearing on the pin and sending a signal signifying the load to the control system which regulates the braking action of the brake with hysteresis in such a manner as to maintain the load at a predetermined value, the path of the wire coming from the above mentioned snub pulley being characterized in that it descends on a first side of the above mentioned second pulley (27) and then winds on the first pulley (28) and returns to the second side of the second pulley (27) on which it winds for 180° and then again descends on the first side towards a wire winding machine (5) located downstream.

GENERAL DESCRIPTION OF THE DRAWINGS

Figure 4:
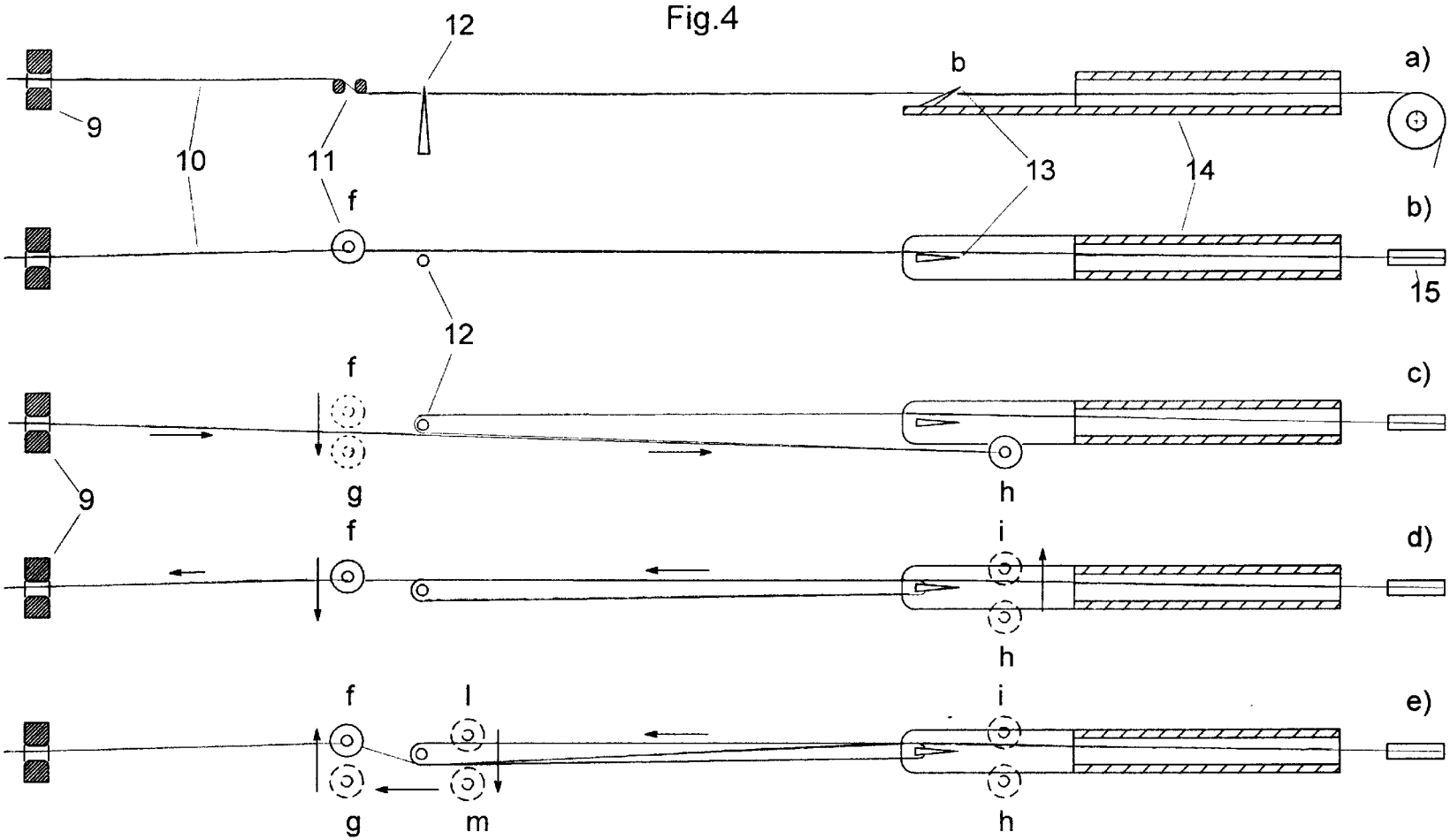
Figure 5:
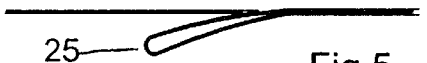
Figure 6:
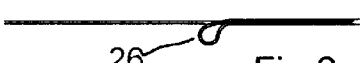
Figures 7, 8, 9:
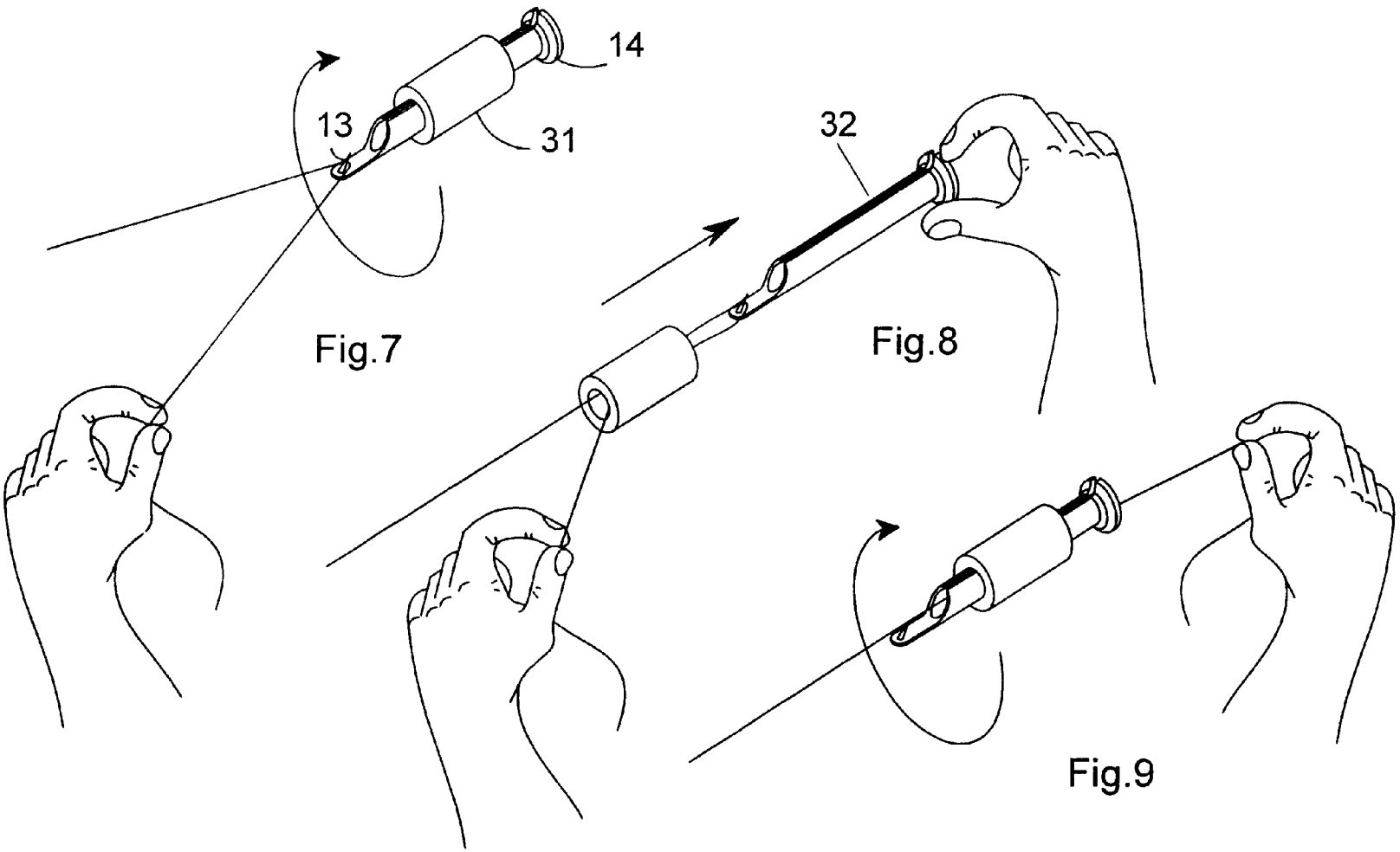

To better clarify the purposes and characteristics of the device in accordance with the present invention an exemplifying embodiment thereof is described below and illustrated in the annexed drawings wherein:

FIG. 1 shows a diagram of a generic electrical-coil winder equipped with a known device for the formation of skeined end sections on the wire of each winding, FIG. 2 shows a generic electrical-coil winder equipped with a device for the formation of skeined end sections in accordance with the present invention, FIG. 3 shows a diagram partially cross-sectioned and partially perspective illustrating the structure of the skeiner 4 of FIG. 2 and the solution idea underlying the present invention, FIG. 4 shows the steps of the skein formation process in accordance with the present invention, FIGS. 5 and 6 show examples of slots (one defective and the other correct) present in the skein at the end of its formation, and FIGS. 7 to 9 show a system for facilitation of manual insertion of the wire in the hole of the rotating shaft 14 of FIG. 3 at the beginning of a coil winding operation.

PREFERRED EMBODIMENTS OF THE INVENTION

FIG. 1 shows the diagram of a generic electrical-coil winder equipped with a known device for the formation of skeined end sections on each winding wire.

In it the various parts represent:

1—the wire feeding bobbin,
2 and 3—two wire-tightening devices with sprung rod,
4'—device for formation of skeined end sections,
5—individual coil winding machine,
6—wire emerging from the skeiner 4' and the tightener 3, and
7—reel on which the coil is wound.

The winding procedure for each coil starts with anchoring of the end of the wire 6 on the coil-holder reel 7. Then with the winder 5 stopped the skeiner 4' is started to create a first skeined wire section on the wire. The winder 5 is then actuated and after anchoring of the first skeined section to the reel 7 continues winding the wire on the reel until stopped near its end Here the skeiner 4' is again actuated to create the second skeined section on the wire. After completion of the latter the winder starts again until it brings the second skeined section onto the coil and anchors it thereto.

During formation of the winding the wire-tightener 3 should ensure a predetermined tension of the wire. However this tightening is irregular and sometimes in jerks, and has a not very precise calibration resulting in possible irregularities in the winding and possible abrasions on the wire insulation film. In addition the presence of the wire-tightener puts a considerable distance which could even reach several meters between the skeiner 4' and the reel 7. This reflects negatively on the possibility of ensuring correct location of the second skeined section on the winding because of the irregular diameter of the external coils of the winding and the considerable number of turns which the reel 7 must complete to bring the second skeined section from the skeiner 4' to the reel 7.

FIG. 2 shows the diagram of a generic electrical-coil winder provided with a device for the formation of skeined end sections in accordance with the present invention. The numbered parts of the diagram have the same meaning as the homologous ones of FIG. 1. This diagram makes clear two first important advantages as compared with, the prior art, to wit:

the system obviates the presence of a rod type wire-tightener downstream of the skeiner because it is replaced by a wire-tightener device inside the skeiner which ensures more constant tension and is adjustable with greater accuracy, and the absence of the second rod type wire-tightener allows reduction of the distance between the skeiner 4 and the reel 7 to values of a few decimeters with a considerable advantage for the possibility of ensuring correct location of the second skeined section on the winding.

FIG. 3 shows a diagrammatic view partially cross-sectioned and partially perspective of the structure of the skeiner 4 and the solution idea underlying the present invention.

In it the various numbered parts represent:

8—wire-tightening device,

9—wire guide bush 10 at the skeiner inlet,

11—wire-pulling ring in which is threaded the wire 10 and which is capable of horizontal traversing parallel to the straight line joining the points of the pins 12 and 13; it is also capable of short traverses perpendicular to the above mentioned straight line achieved on command of an electromagnet not shown in the figures,

12 and 13—pins supporting the wire skeins used for creation of the skeined parts,

14—shaft supporting the pin 13,

15—pulley rotating idly and functioning during skeining as a wire anchor point,

16—supporting slide capable of horizontal traversing supporting the pin 12 and a sprung tooth 17 engaging in a fixed rack 18,

19 and 20—electromagnets controlling re-entry of the pin 12 and the tooth 17 respectively,

21—belt mounted on two pulleys 22 and 23 and driven by a stepping motor controlled and programmed through a control panel not shown in the figures, and

24—pulling slide capable of horizontal traversing connected to the upper branch of the belt 21 for pulling the ring 11 and the supporting slide 16.

Operation of the skeiner provides that initially the pulling slide 24 pulls the support slide 16 (with tooth 17 raised) in a position such that the distance between the teeth 12 and 13 corresponds to the desired length of the skeined wire section to be created.

After reaching this position an anchor device (not shown in the FIGS.) driven by an electromagnet unanchors the support slide 16 from the slide 24. Simultaneously the electromagnet 20 commands descent of the tooth 17 which locks the support slide 16 in the desired position.

At this point the wire-pulling ring 11 winds the wire 10 on the two pins 12 and 13 to create thereon a skein of three or more coils. After finishing the number of coils the pin 12 is rotated until it reaches a desired number of twistings.

The electromagnet 19 then withdraws the pin 12 to allow the winder 5 downstream to start up again and pull the skeined wire out of the skeiner and start or finish the coil depending on whether the winding formation process is starting or ending.

The skeined wire section formation process is now described in greater detail with reference to FIGS. 4*a*) to *e*) where FIG. 4*a*) shows the upper part of FIG. 3 and FIGS. 4*b*) to *e*) show top views of the components of FIG. 4*a*) during different steps of the skein formation process.

As shown in FIG. 4*a*) the points of the pins 12 and 13 are at the same level and the levels of the two wire branches departing from the upper and lower surfaces respectively of the ring 11 are respectively above and below the level of said points.

At the beginning of the skeining the ring 11 is in position f of FIG. 4*b*) and the wire 10 is stopped.

FIG. 4*c*) shows the first two steps of the formation process of the first coil around the points 12 and 13. In these two steps the ring 11 goes first from f to g and then from g to h. During the step f–g the wire goes and rests against the point of the pin 12. In the step g–h the wire entering from the bush 9 is drawn by a length equal to twice the distance between point 12 and the ring in position h, while the wire emerging from the pulley 15 remains stopped.

FIG. 4*d*) shows the third and fourth steps of the first-coil formation process. In the third step the ring 11 moves from position h to position i and during this movement the upper branch of the wire entering the ring moves above the point of the pin 13 while the lower branch moves under that point to go and rest against the pin base.

During the fourth phase the ring 11 moves from position h to departing position f and a wire section equal to approximately twice the distance between the base of the pin 13 and the center of the ring in position i) is released and emerges from the bush 9.

The process described above is repeated until the next to last coil of the skein has been formed. Indeed, if the last coil were also completed like the preceding ones, at the end of the twisting process (rotation of the shaft 14 and subsequent lowering of the pin 12) a slot 25 (FIG. 5) of considerable size and capable of causing easy undoing of the skein and tangling would be found to the left of the skein.

To avoid this problem the last coil of the skein is made as shown in FIG. 4*e*). In accordance with this variant the steps f, g, h, i (outward steps) of the ring are still accomplished like the preceding ones while the step i–f (return step) is no longer direct but calls for the path i, l, m, g, f. This variant of the return path causes the last side of the last coil to be arranged obliquely instead of parallel to the preceding ones and this has considerable consequences during twisting because in this last step the above mentioned last side closes around the other coils to produce in comparison therewith an effect similar to that of a necktie so that the resulting slot 26 at the end of the process is quite acceptable as shown in FIG. 6.

The structure and operation of the wire-tightener 8 of FIG. 3 are now described.

The wire-tightener 8 is regulated by the same electronic control system with microprocessor controlling the overlying skeiner. The pulleys 27 and 28 are in it.

The pulley 28 is mounted on a shaft connected to a electromagnetic brake 29 with electromagnetic hysteresis rotated by a ratiomotor with rotation direction contrary to the wire motion. When the wire runs towards the winder 5 located downstream the pulley 28 turns as it is pulled by the wire and exerting thereon a resistant load proportionate to the voltage applied to the electromagnetic brake by the control system.

Above the pulley 28 is the pulley 27 mounted as an idler on a pin in turn mounted on a cell 30 sensitive to the load bearing on the pin.

The wire coming from the skeiner descends on the left-hand side of the pulley 27, winds onto the pulley 28, returns from the right-hand side onto the pulley 27 on which it winds for 180° and then descends on the left-hand side towards the winder 5. When the wire is recalled by the winder 5 it exerts a certain load on the pin of the pulley 27 and consequently on the cell 30 which transmits a voltage indicating the load to the control system. The latter controls the brake 29 on the basis of the admitted loads set by the operator.

The pulley 28 also fulfills a wire recovery action when the winder 5 releases the wire instead of drawing it back. In this case the pulley 28 is pulled to move contrary to the normal direction by the hysteresis brake 29, making an excess wire recovery. At the same time the falling of the load on the pulley 27 is perceived by the cell 30 which, through the control system, commands starting of the wire-pulling ring 11 which (moving in a direction contrary to that of winding of the coils indicated in FIGS. 4*c*) to 4*d*)) winds the excess wire around the pins to recover the excess wire; in this way the load on the wire is always kept within its admitted values.

FIGS. 7 to 9 concern a system conceived for facilitating manual insertion of the wire in the hole of the rotation shaft 14 of FIG. 3 at the start of a coil winding operation.

The shaft 14 has a side cut 32 and is mounted in the through hole of a sleeve 31 which in turn is mounted on bearings (not shown in the figures). The wire is hooked to the pin 13 and is extracted therewith from the other side of the sleeve 31 and then located axially in the shaft 14 through the cut 32.

Lastly the shaft 14 is put back in the sleeve 31 guided by a rib in the sleeve engaging with the above mentioned cut.

Naturally the above description of an embodiment applying the solution idea of the present invention is given by way of non-limiting example. Therefore numerous changes, adaptations, variants and replacement of members by other functionally equivalent ones could be made without departing from the scope of the invention.

One of these variants could concern the wire-pulling ring 11 which could be replaced by a wire-pulling device having another configuration e.g. spiral or tubular.

What is claimed is:

1. Device for the formation of skeined sections on thin metallic wires in which the wire to be skeined extends from an inlet (9) to an anchor point (15) and is placed under traction by a wire-tightening device (2), and in which are present:

a first pin (12) and a second pin (13) whose points are placed at the same level with the first pin which can be removed from its position and the second pin located on a first shaft with a horizontal axis, a wire pulling device (11) in which the wire to be skeined can run, capable of traversing on a horizontal plane placed at the same level as the points of the above mentioned pins, a skeined section of wire being achieved through a movement of winding the wire in multiple coils on the above mentioned pins by said wire-pulling device, said movement of winding being followed by a rotation movement of said first shaft around its own axis, the above mentioned movements being commanded by an electronic control system, said device being characterized in that the above mentioned anchor point (15) consists of a snub pulley on which the wire rests and that the branch of said wire emerging from said snub pulley is sent to a wire-tightening device (8) controlled by the same electronic control system which controls the skeined wire section formation operation, in said wire-tightener being present the following parts:

a first pulley (28) on which winds said emerging wire and which is mounted on a second shaft connected to an electromagnetic brake (29) with electromagnetic hysteresis rotated in a direction contrary to the motion given the pulley by the wire, a second pulley (27) located above the first pulley (28) and mounted in an idling manner on a pin in turn mounted on a cell (30) sensitive to the load bearing on the pin and sending a signal signifying the load to the control system which regulates the braking action of the brake with hysteresis in such a manner as to maintain the load at a predetermined value, the path of the wire coming from the above mentioned snub pulley being characterized in that it descends on a first side of the above mentioned second pulley (27) and then winds on the first pulley (28) and returns to the second side of the second pulley (27) on which it winds for 180° and then again descends on the first side towards a wire winding machine (5) located downstream.

2. Device in accordance with claim 1 characterized in that the first pulley (28) also performs a wire recovery action when the winder (5) instead of drawing the wire back releases it, with the first pulley (28) commanded in this case to reverse the motion by the hysteresis brake (29) and with the fall of the load on the second pulley (27) being at the same time perceived by the above mentioned cell (30) which through the above mentioned control system commands operation of the wire pulling device (11) which winds the excess wire around the pins, in this way keeping the load on the wire within its admitted values.

3. Device in accordance with claim 1 characterized in that movement of the wire-pulling device (11) is programmed in such a manner that the last side of the last coil wound is oblique with respect to the sides of the preceding coils.

4. Device in accordance with claim 1 characterized in that the above mentioned first shaft (14) is hollow and that to facilitate manual insertion of the wire in the hole of said shaft the latter has a side cut (32) and is mounted in the through hole of a sleeve (31) which is in turn mounted on bearings with said wire being hooked during the above mentioned insertion to the above mentioned second pin (13) and being withdrawn therewith from the side of the sleeve opposite the pin and then located axially in said first shaft (14) through said cut.

* * * * *